US010702000B2

(12) United States Patent
Hillie

(10) Patent No.: US 10,702,000 B2
(45) Date of Patent: Jul. 7, 2020

(54) HAT WITH AN ADJUSTABLE BRIM SIZE

(71) Applicant: James Lee Hillie, Washington, DC (US)

(72) Inventor: James Lee Hillie, Washington, DC (US)

( * ) Notice: Subject to any disclaimer, the term of this patent is extended or adjusted under 35 U.S.C. 154(b) by 264 days.

(21) Appl. No.: 15/419,226

(22) Filed: Jan. 30, 2017

(65) Prior Publication Data

US 2018/0213872 A1 Aug. 2, 2018

(51) Int. Cl.
*A42B 1/20* (2006.01)
*A42B 1/02* (2006.01)

(52) U.S. Cl.
CPC ..... *A42B 1/205* (2013.01); *A42B 1/02* (2013.01)

(58) Field of Classification Search
CPC ..... A42B 1/205; A42B 1/206; A42B 1/22; A42B 1/201; A41B 1/20; A42C 1/00; A42C 3/00
USPC ..... 2/175.3, 175.4
See application file for complete search history.

(56) References Cited

U.S. PATENT DOCUMENTS 128,780 A * 7/1872 Battle ..... A42B 1/247 2/10
1,160,049 A * 11/1915 Craw et al. ..... A42B 1/22 2/175.3
1,163,287 A * 12/1915 Van Raalte ..... A42B 1/041 2/207
1,446,938 A * 2/1923 Shepherd ..... A43C 7/08 2/175.3
1,587,681 A * 6/1926 Schumacher ..... A42B 1/18 2/175.6
2,617,110 A * 11/1952 Rosenblatt ..... A42B 1/02 2/175.2
2,845,289 A * 7/1958 Cicogna ..... A42B 1/201 2/175.2
4,993,081 A * 2/1991 Fulghum ..... A42B 3/227 2/209.12
5,369,808 A * 12/1994 Brewer ..... A42C 5/00 2/175.3
5,406,645 A * 4/1995 Lin ..... A42B 1/062 2/10
5,548,846 A * 8/1996 Bianchetti ..... A42B 1/064 2/10
5,592,696 A * 1/1997 Oliver ..... A42B 1/02 2/175.3
5,694,647 A * 12/1997 Crickmore ..... A42B 1/067 2/10
5,727,250 A * 3/1998 Black ..... A42B 3/227 2/10
5,915,533 A * 6/1999 Halle ..... A42B 1/02 2/175.5
6,061,835 A * 5/2000 Lien ..... A42B 1/02 2/175.5
6,260,204 B1 * 7/2001 Morrissey ..... A42B 3/003 2/172
6,260,208 B1 * 7/2001 Wang ..... A42B 1/062 2/171.03
6,484,323 B1 * 11/2002 Pu ..... A42B 1/201 2/10

(Continued)

*Primary Examiner* — Alissa L Hoey
(74) *Attorney, Agent, or Firm* — BakerHostetler

(57) ABSTRACT

A hat with a variable brim. The wearer of the hat may select to wear a hat with a given brim length. The wearer may choose to extend the brim length by fastening a material, an extendable brim portion, to the original brim of the hat. In this manner, the hat wearer may adjust the brim length to satisfy the hat wearer's needs.

7 Claims, 4 Drawing Sheets

(56) References Cited

U.S. PATENT DOCUMENTS

D617,539 S * 6/2010 Boles ..... D2/893
7,971,278 B2 * 7/2011 Klamerus, Jr. ..... A42B 1/18 2/172
D720,502 S * 12/2014 Schrock ..... D29/122
D720,892 S * 1/2015 Bryan ..... D29/122
8,973,166 B1 * 3/2015 Engle ..... A42B 1/063 2/175.1
9,277,778 B1 * 3/2016 Fulper ..... A42B 1/064
9,498,015 B2 * 11/2016 Kim ..... A42B 3/227
2005/0172380 A1 * 8/2005 Turkington ..... A42B 1/248 2/175.4
2008/0060117 A1 * 3/2008 Timms ..... A42B 1/08 2/171
2009/0064394 A1 * 3/2009 White ..... A42B 1/22 2/183
2010/0162464 A1 * 7/2010 Beard ..... A42C 5/00 2/175.3
2010/0186147 A1 * 7/2010 Garza ..... A42B 1/205 2/209.12
2011/0099691 A1 * 5/2011 Duwyn-Zylstra ..... A42B 1/22 2/175.1
2012/0210491 A1 * 8/2012 Bryan ..... A42B 3/0406 2/181.4
2013/0047323 A1 * 2/2013 Ireland ..... A42B 3/003 2/422
2013/0174322 A1 * 7/2013 Williams ..... G09F 21/026 2/181
2013/0180035 A1 * 7/2013 Lowther ..... A42B 1/24 2/422
2014/0338103 A1 * 11/2014 Tsai ..... A42C 5/00 2/244
2015/0113707 A1 * 4/2015 Tsai ..... A42B 1/206 2/209.13
2016/0353824 A1 * 12/2016 Smith ..... A42B 1/22
2016/0374422 A1 * 12/2016 Denny ..... A42B 1/205 2/410

* cited by examiner

HAT WITH AN ADJUSTABLE BRIM SIZE

BACKGROUND

1. Field of the Disclosure

The disclosure is directed to a hat with an adjustable brim. More specifically, an adjustable brim allows a hat wearer to purchase a standard hat and modify the size of the brim by fastening a material to the hat to lengthen the brim.

2. Background

Hats have been worn since at least the time of ancient Egypt. Over time, many different types of hats have been utilized. Hats have been worn for fashion statements, for practical purposes, such as to protect the wearer from the sun, or for many other reasons. Some hats, such as a summer hat, have a brim, while other hats, such as a fez, do not. In the current state of the art, hats have a fixed brim length; that is, the hat wearer cannot change the size of the brim once the hat is manufactured. This is a disadvantage of current hats since a hat wearer may wish to wear a certain type of hat, but will not because, for example, the brim may not be suited for the weather.

Accordingly, there is a need for a hat with an adjustable brim so that, for example, the hat may be worn in many different weather conditions or to make different fashion statements.

SUMMARY

Additional features, advantages, and aspects of the disclosure may be set forth or apparent from consideration of the following detailed description, drawings, and claims. Moreover, it is to be understood that both the foregoing summary of the disclosure and the following detailed description are exemplary and intended to provide further explanation without limiting the scope of the disclosure as claimed.

In one aspect of the disclosure, a hat with a variable size brim including a crown, a brim with a radius, and an extendable brim portion fastened to the brim is disclosed.

In another aspect of the disclosure, a method of constructing a hat with a variable size brim including sizing an extendable brim portion according to customer specifications, cutting the extendable brim portion so that the extendable brim portion has an inner radius and an outer radius, and fastening the extendable brim portion to a brim with a radius of a hat.

In a still further aspect of the disclosure, a hat with a variable size brim, optionally fixed with a permanent adhesive, or optionally detached utilizing a ring comprised of Velcro™.

BRIEF DESCRIPTION OF THE DRAWINGS

The accompanying drawings, which are included to provide a further understanding of the disclosure, are incorporated in and constitute a part of this specification, illustrate aspects of the disclosure and together with the detailed description serve to explain the principles of the disclosure. No attempt is made to show structural details of the disclosure in more detail than may be necessary for a fundamental understanding of the disclosure and the various ways in which it may be practiced. In the drawings.

DETAILED DESCRIPTION

Figure 1:
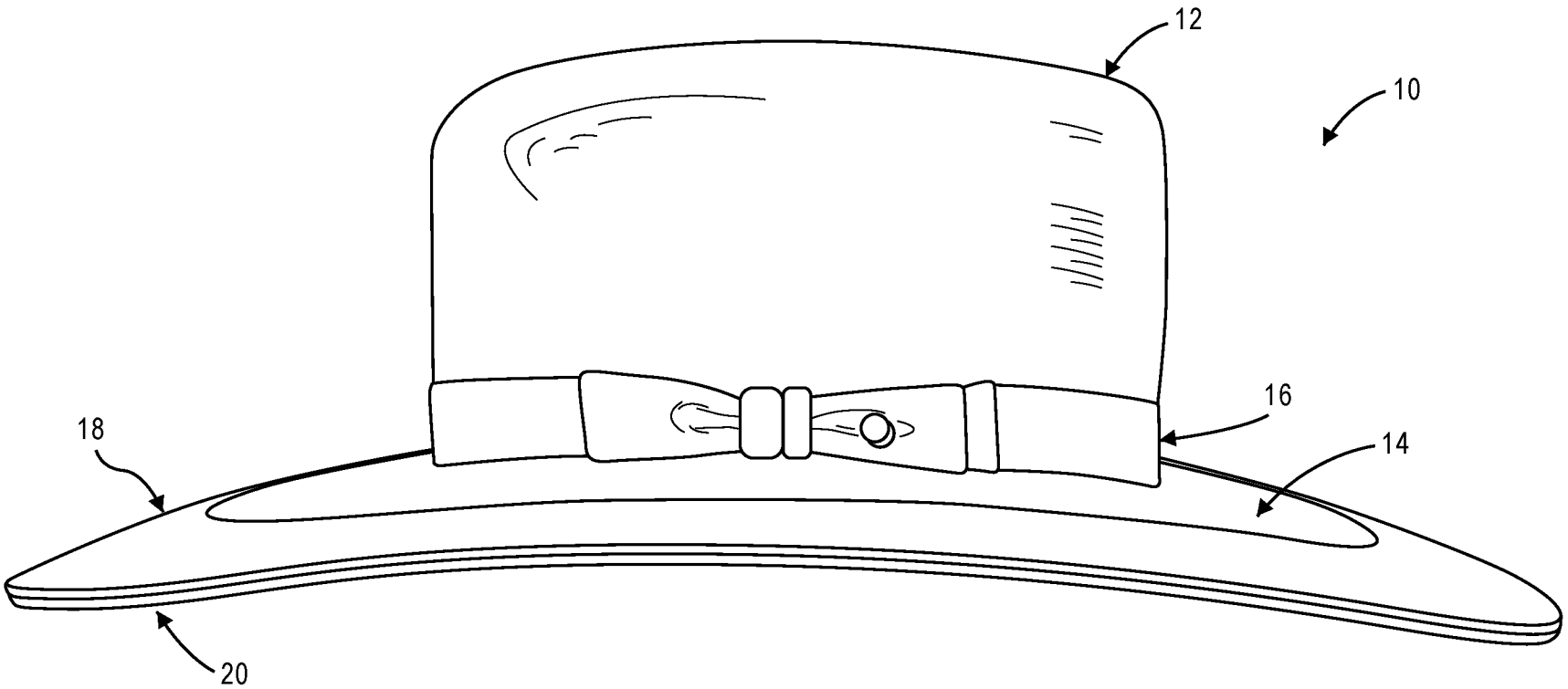
FIG. 1 shows a side view of a hat, according to one aspect of the disclosure.

The aspects of the disclosure and the various features and advantageous details thereof are explained more fully with reference to the non-limiting aspects and examples that are described and/or illustrated in the accompanying drawings and detailed in the following description. It should be noted that the features illustrated in the drawings are not necessarily drawn to scale, and features of one aspect may be employed with other aspects as the skilled artisan would recognize, even if not explicitly stated herein. Descriptions of well-known components and processing techniques may be omitted so as to not unnecessarily obscure the aspects of the disclosure. The examples used herein are intended merely to facilitate an understanding of ways in which the disclosure may be practiced and to further enable those of skill in the art to practice the aspects of the disclosure. Accordingly, the examples and aspects herein should not be construed as limiting the scope of the disclosure, which is defined solely by the appended claims and applicable law. Moreover, it is noted that like reference numerals represent similar parts throughout the several views of the drawings.

FIG. 1 is a side view of a hat, according to one aspect of the disclosure. In particular, FIG. 1 illustrates an exemplary hat 10 of an adjustable brim type. The hat 10 is preferably a flat brimmed hat; however, hats with uneven brims are contemplated as well. For example, sun hats, boaters, bowlers, chupallas, sombreros, and fedoras may be used. The hat 10 includes a standard hat with standard components, such as a crown 12 and a brim 14. The crown 12 may be reinforced with support material, for example, a ring of rope (not shown), located inside the crown 12 to ensure that the crown 12 maintains its shape. The brim 14 has an upper surface and a lower surface. In the prior art, the length of the brim 14 extending outward from the base of the crown 12 is set by the hat manufacturer and cannot be changed. The hat 10 may also include a sweatband or a hatband 16.

To overcome the limitation of a fixed brim length, two pieces of material may be attached to the brim 14. Alternatively, only one piece of material may be attached to the brim 14. Additionally, more than two pieces of material may be used. In the aspect where two pieces of material are utilized, an upper material 18 and a lower material 20, may be used. The upper material 18 and the lower material 20 may be designed and attached to extend the brim 14, as shown in FIG. 1. The length of the extended brim may be constant or it may vary along the perimeter of the extended brim. Moreover, the perimeter of the extended brim may contain a wire (not shown) to change a shape of the extendable brim. The upper material 18 may be removably attached to the upper surface of the brim 14. The upper material 18 may partially overlap with the upper surface of the brim 14. Temporary fasteners, such as snaps, hook and loop fasteners, such as Velcro™, temporary adhesive or any other type of temporary fastener, may be used. Alternatively, the upper material 18 may be permanently attached to the brim 14 using, for example, general purpose industrial and construction adhesives, such as 9001 High-Strength Adhesive by Surebonder™ or a variety of AMAZING GOOP™ adhesives, or any other permanent fastener. The fastening mechanism, whether temporary or permanent, may be waterproof to increase the durability and versatility of the hat 10. The upper material 18 may be made of, for example, leather, artificial leather, such as Naugahyde™ vinyl or the like.

The lower material 20 may be attached to the upper material 18, the lower surface of the brim 14, or both. The lower material 20 may be attached so that the lower material 20 is in contact with a portion of the upper material 18 that extends beyond the brim 14. Temporary fasteners, such as snaps, hook and loop fasteners, such as Velcro™, temporary adhesive, or any other type of temporary fastener, may be used. Alternatively, the lower material 20 may be permanently attached to the upper material 18, the lower surface of the brim 14, or both, using, for example, general purpose industrial and construction adhesives, such as 9001 High-Strength Adhesive by Surebonder™ or a variety of AMAZING GOOP™ adhesives, or any other permanent fastener. The fastening mechanism, whether temporary or permanent, may be waterproof to increase the durability and versatility of the hat 10. The lower material 20 may be made of the same material as the upper material 18, such as, for example, leather, artificial leather, such as Naugahyde™, or vinyl. Alternatively, the lower material 20 may be made from a material different from the upper material 18.

Figure 2:
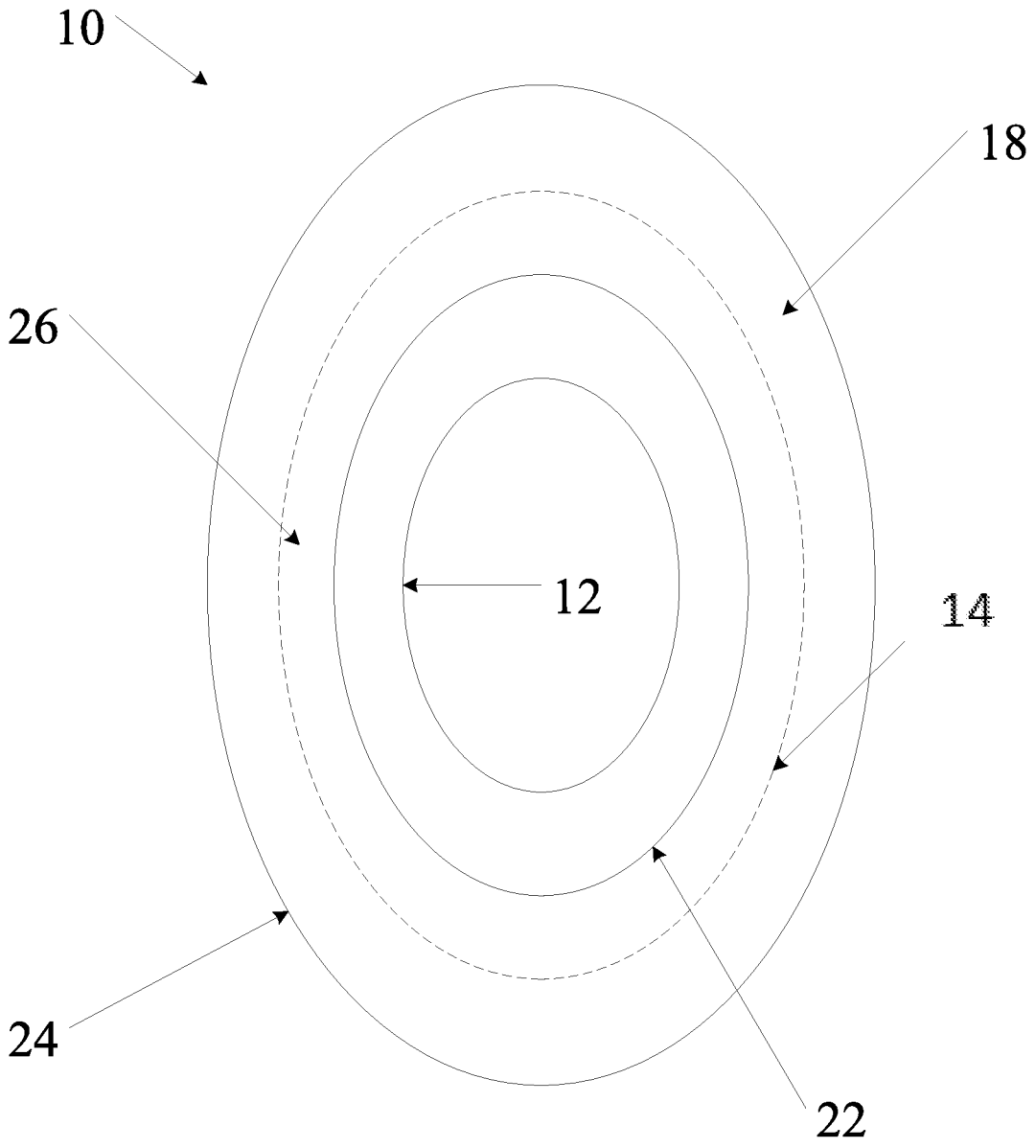
FIG. 2 shows a top view of a hat, according to one aspect of the disclosure.

FIG. 2 shows a top view of the hat 10, according to one aspect of the disclosure. FIG. 2 shows the hat 10 with a crown 12 and an original brim 14 of the hat 10 in dashed lines. The upper material 18 may have an inner radius 22 and an outer radius 24. The inner radius 22 of the upper material 18 may be smaller than the radius of the original brim 14 of the hat 10 while the outer radius 24 of the upper material 18 may be larger than the radius of the original brim 14 of the hat 10. The outer radius 24 of the upper material 18 may be sized so that it extends beyond the original radius of the brim 14. Thus, by varying the size of the outer radius 24 of the upper material 18, and thus the overall radius of the hat 10, the hat wearer may use the hat 10 in many different situations. The outer radius 24 may be sealed to increase the durability of the hat 10. An overlap region 26 indicates the region where the upper material 18 may be in contact with the original brim 14. As previously described, various fasteners, for example, hook and loop fasteners, such as Velcro™ or general purpose industrial and construction adhesives, such as 9001 High-Strength Adhesive by Surebonder™, may fasten the upper material 18 to the original brim 14 in an overlap region 26.

Figure 3:
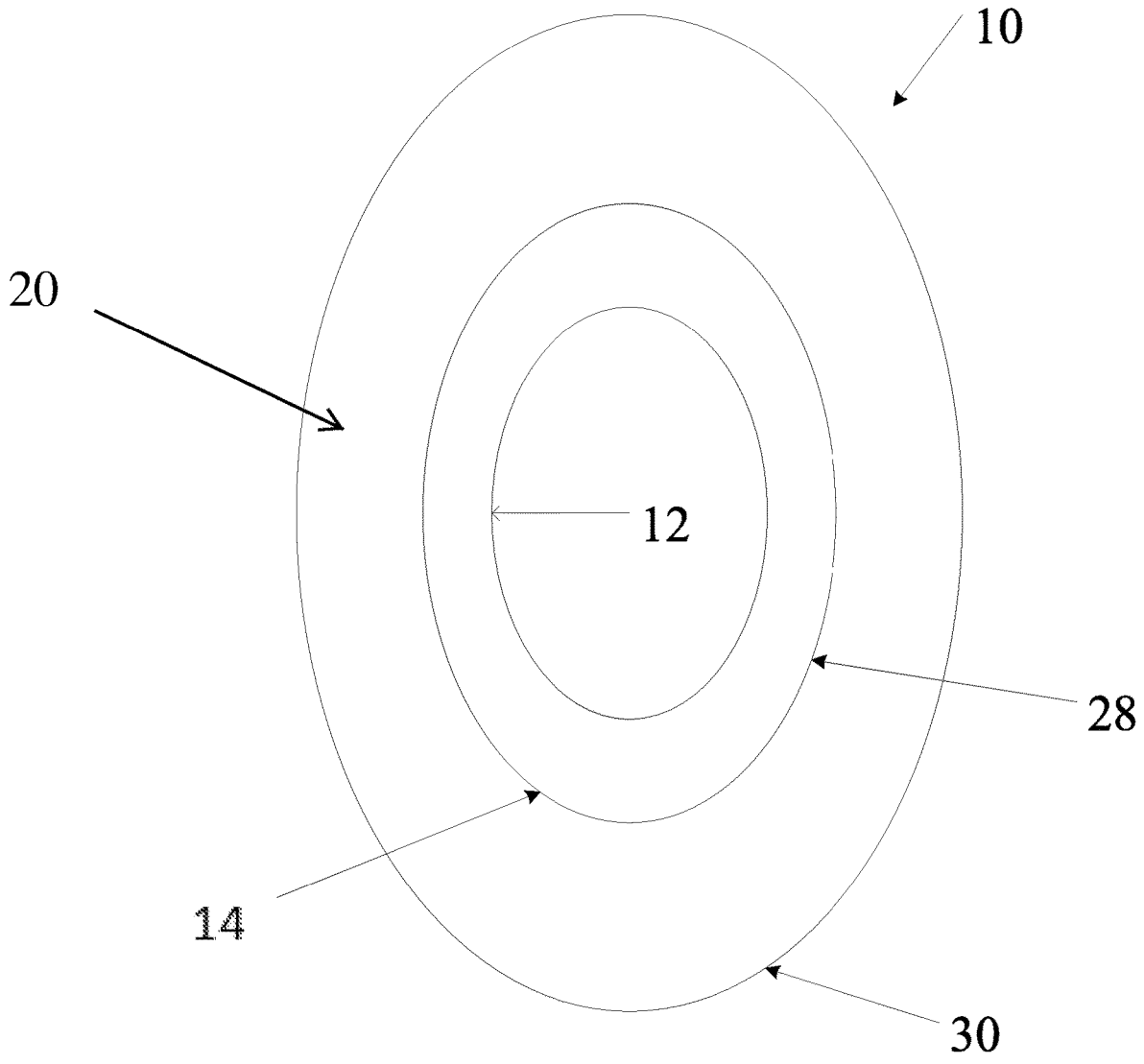
FIG. 3 shows a bottom view of a hat, according to one aspect of the disclosure.

FIG. 3 shows a bottom view of the hat 10, according to one aspect of the disclosure. FIG. 3 shows the hat 10 with a crown 12 and an original brim 14 of the hat 10. The lower material 20 may have an inner radius 28 and an outer radius 30. The inner radius 28 and the outer radius 30 of the lower material 20 may, but need not, be the same as the inner radius 22 and the outer radius 24 of the upper material 18 respectively. The inner radius 28 of the lower material 20 may have a radius equal to the radius of the brim 14 as measured from the center of the hat 10. The outer radius 30 may have a radius equal to the outer radius 24 of the upper material 18. The inner radius 28 of the lower material 20 may be sized so that it begins where the original brim 14 of the hat 10 ends while the outer radius 30 may be sized so that it is coterminous with the outer radius 24 of the upper material 18 (see FIG. 2). The lower material 20 may be removably or permanently fastened to the upper material 18, the lower surface of the brim 14, or both, using temporary or permanent fasteners, for example, hook and loop fasteners, such as Velcro™ or general purpose industrial and construction adhesives, such as 9001 High-Strength Adhesive by Surebonder™.

Figure 4:
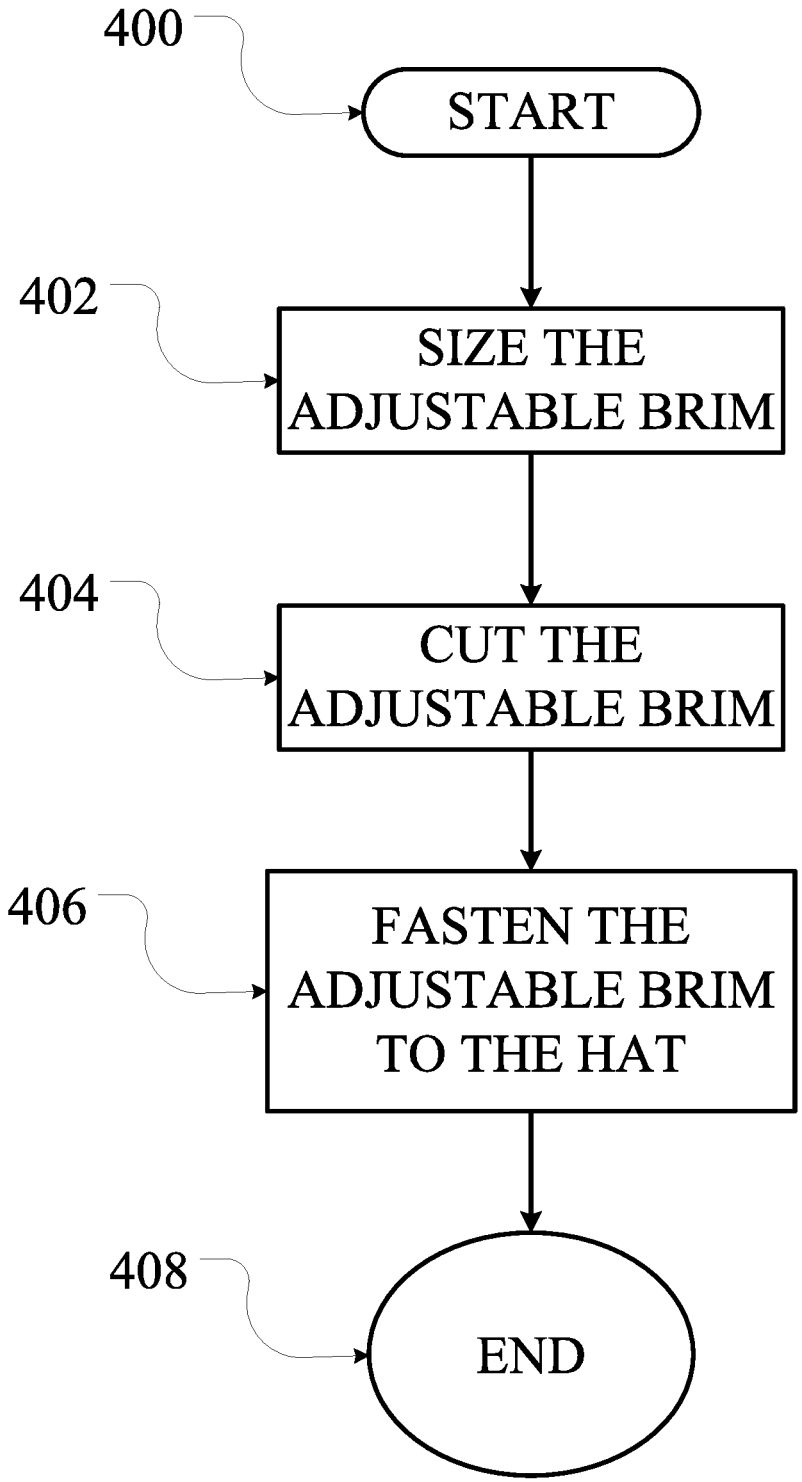
FIG. 4 shows a flowchart illustrating a method of making a hat, according to one aspect of the disclosure.

FIG. 4 shows a flowchart illustrating a method of making the hat, according to one aspect of the disclosure. The method begins at step 400 and proceeds to step 402. At step 402, the size of the adjustable brim is measured. The measurements, generally but not always, are specified by a customer who will wear the hat with the adjustable brim. The customer may provide specifications indicating how much she would like to extend the brim, that is, the outer radius of the upper material 18, the lower material 20, or both. However, the customer may not provide specifications for the inner radius. Thus, the inner radius may be chosen by the manufacturer of the adjustable brim so that it overlaps with the original brim. After the adjustable brim is sized, the method may proceed to step 404.

At step 404, the adjustable brim may be cut according to the results of step 402. After the adjustable brim is cut, the method may proceed to step 406.

At step 406, the adjustable brim may be fastened to the hat 10. As previously described, many different types of fasteners may be used to removably or permanently fasten the adjustable brim to the hat 10. After the adjustable brim is fastened to the hat, the method ends at step 408.

The present description is for illustrative purposes only, and should not be construed to narrow the breadth of the present disclosure in any way. Thus, those skilled in the art will appreciate that various modifications might be made to the presently disclosed embodiments without departing from the full and fair scope and spirit of the present disclosure. Other aspects, features and advantages will be apparent upon an examination of the attached drawings and appended claims.

What is claimed is:

1. A method of customizing a hat with an extendable brim portion, the hat including a crown having a center, a base extending circumferentially around the center and having a base size and a base geometric shape, and an original brim extending circumferentially around the center, the original brim having inner and outer original brim edges, the inner and outer original brim edges comprising a same geometric shape and alignment as the base geometric shape, the inner original brim edge having a size that comprises a same size as the base size and is fixed to the base, the outer original brim edge having a size that is larger than the base size such that the outer original brim edge extends an outer original brim edge radial distance from the base, the method comprising:

sizing an upper material, made of one of leather and artificial leather, of the extendable brim comprising:

cutting the upper material to form an outer upper material edge such that the outer upper material edge is the same geometric shape as the base geometric shape and has a size larger than the size of the outer original brim edge; and cutting the upper material to form an inner upper material edge such that the inner upper material edge is the same geometric shape as the base geometric shape and has a size smaller than the size of the outer upper material edge and a size greater than the size of the inner original brim edge to expose an upper portion of the original brim between the inner upper material edge and the base;

sizing a lower material, made of one of leather and artificial leather, of the extendable brim including:

cutting the lower material to form an outer lower material edge such that the outer lower material edge is the same geometric shape as the base geometric shape, the outer lower material edge having a size that is the same as the size of the outer upper material edge; and cutting the lower material to form an inner lower material edge such that the inner lower material edge is the same geometric shape as the base geometric shape and has a size smaller than the size of the outer lower material edge and greater than the size of the inner original brim edge to expose a lower portion of the original brim between the inner lower material edge and the base;

placing the upper material on an upper surface of the original brim such that the inner upper material edge is centered around the center of the crown such that the crown extends through an opening formed by the inner upper material edge;

fastening a lower surface of the upper material to the upper surface of the original brim by disposing fasteners between the lower surface of the upper material and the upper surface of the original brim;

placing the lower material on a lower surface of the original brim such that the inner lower material edge is centered around the center of the crown;

fastening an upper surface of the lower material to the lower surface of the original brim by disposing fasteners between the upper surface of the lower material and the lower surface of the original brim; and fastening the lower surface of the upper material to the upper surface of the lower material by:

disposing fasteners between the lower surface of the upper material and the upper surface of the lower material;

forming a coterminous outer extendable brim edge from the outer upper material edge and the outer lower material edge, the lower surface of the upper material and the upper surface of the lower material being fastened together at the coterminous outer extendable brim edge; and sealing the coterminous outer extendable brim edge to increase durability of the hat.

2. The method of customizing the hat with the extendable brim portion of claim 1, wherein the size of the upper material edge is based upon customer specifications.

3. The method of customizing the hat with the extendable brim portion of claim 2, wherein the customer specifications include an amount at which the coterminous outer extendable brim edge extends beyond the outer original brim edge radial distance.

4. The method of customizing the hat with the extendable brim portion of claim 1, wherein the original brim and the extendable brim completely surround the crown.

5. The method of customizing the hat with the extendable brim portion of claim 1, wherein each of the fasteners are hook-and-loop fasteners.

6. The method of customizing the hat with the extendable brim portion of claim 1, wherein the crown of the hat is reinforced with a ring of rope.

7. The method of customizing the hat with the extendable brim portion of claim 1, wherein the extendable brim portion comprises a wire configured, structured, and arranged to change a shape of the extendable brim portion.

* * * * *